United States Patent [19]

Borgert et al.

[11] 4,330,581

[45] May 18, 1982

[54] SEALING ELEMENT

[75] Inventors: Bernhard Borgert; Udo Liche, both of Mannheim, Fed. Rep. of Germany

[73] Assignee: Braas & Co. GmbH, Frankfurt, Fed. Rep. of Germany

[21] Appl. No.: 91,565

[22] Filed: Nov. 5, 1979

[30] Foreign Application Priority Data

Jul. 18, 1979 [DE] Fed. Rep. of Germany ... 7920530[U]

[51] Int. Cl.[3] ..... B32B 3/02; E04C 1/00

[52] U.S. Cl. ..... 428/64; 52/58; 52/96; 428/174

[58] Field of Search ..... 428/80, 81, 174, 64; 52/58, 96, 309.1; 277/12

[56] References Cited

U.S. PATENT DOCUMENTS 1,640,987 8/1927 Gray ..... 428/80

FOREIGN PATENT DOCUMENTS 736647 6/1966 Canada ..... 52/58

7042051 3/1974 Fed. Rep. of Germany .

*Primary Examiner*—Paul J. Thibodeau

*Attorney, Agent, or Firm*—Browdy and Neimark

[57] ABSTRACT

A sealing element is provided which is suitable for sealing flat roofs and engineering structures. The sealing element is made of a water-resistant elastomer or plastomer, and comprises a lamelliform structure of substantially circular shape having from four to six waves, inclusively, distributed radially throughout the structure and around the entire circumference of the structure, the amplitudes of which waves increase regularly from the center of the structure towards the circumference. The undulations enable the sealing element to have an effective surface covering more than 360° without straining any region of the element.

9 Claims, 3 Drawing Figures

SEALING ELEMENT

BACKGROUND OF THE INVENTION

This invention relates to a sealing element made of water-resistant elastomers or plastomers for outer corners on flat roofs and engineering constructions.

When sealing flat roofs and engineering constructions by means of plastics sheets, the sealing of corners against water (whether under pressure or not) causes serious problems. This is the case when sealing outer corners where two surfaces, which meet at an angle and are often mutually perpendicular, extend into an almost horizontal surface, as in the case of a structural part being brought through a flat roof, e.g. a chimney; and also when sealing inner corners, where two mutually perpendicular surfaces meeting at an angle enclose a horizontal surface as a boundary. In order to simplify the construction work, specially shaped sealing elements made of weather-resistant, resilient plastics materials which match the corners in question are used, the sealing elements being welded or stuck to the edges of the laid plastics sheets adjoining the corner areas.

Known shaped sealing elements of this kind (see for example German Utility Model No. 70 42 051) are generally manufactured from plane cuts of a corresponding plastics sheet using the cupping process. When forming outer corners, these cuts must be greatly stretched in the area enclosing the projecting edge of the corner. The sealing element is therefore subject to the greatest extension along the line where it will abut the outer edge of the projecting corner. However, during construction of the roof, the shaped sealing element is most liable to damage on this edge. In addition the stretching in this edge area increases with increasing distance from the corner point of the shaped part, by virtue of which the known sealing elements for outer corners are limited in their total overall size. Similarly, if the thickness of the material exceeds a certain size there is the danger that the sealing element will tear from the border at the edge enclosing the outer corner.

SUMMARY OF THE INVENTION

An object of the invention is to produce a sealing element, suitable for covering outer corners of flat roofs, which may be manufactured by means of cupping or pressing from a plane material cut, and in which the stretching of the material occurring with the cupping or pressing is distributed as uniformly as possible over the entire circumference of the cut.

According to the present invention, there is provided a sealing element made of a water-resistant elastomer or plastomer for outer corners on flat roofs and engineering constructions, which comprises a lamelliform structure of substantially circular shape having four to six waves inclusively distributed radially throughout the structure and around the entire circumference of the structure, the amplitudes of which waves increase regularly from the centre of the structure towards the circumference.

DESCRIPTION OF THE PREFERRED EMBODIMENTS

The amplitudes of the waves preferably increase in a linear manner from the centre of the structure towards the circumference.

By virtue of the undulations present in the structure, the circumference can be considered as extending over more than 360°. This concept may better be appreciated by reference in FIG. 3 of the accompanying drawings, where one embodiment of the sealing element is shown in the conformation it will have in use. Here it is seen that the circumference of the structure effectively extends over $(360-\alpha)°$ plus the portion which is upstanding from the flat basal portion. In the embodiment of FIG. 3, this upstanding portion amounts to 180°. Thus the structure can in general be considered to have a surface enlarged by an additional circular sector relative to a complete circular surface. This can be termed an "excess sectorial surface".

When in use, the sealing element of this invention is no longer enlarged at only one pre-determined place along its circumference in order to enclose the corner edge; the preferably circular element is extended over its entire circumference in an essentially uniform manner, whereby the additional circumferential length is absorbed by the waves distributed around the circumference. Due to the elasticity of the material, the sealing element can be laid flat with the largest part of its circumference on the basal surface to be covered so that the excess circumferential length is transferred into a single convexity which then encloses the projecting corner (in the manner shown in FIG. 3). In addition to the uniform distribution of material thickness in the circumferential direction the new sealing element has the advantage that its fitting position is not fixed; instead it can be placed in any position in respect of the angle of rotation whatever, related to its centre, in the same way on the corner which is to be enclosed.

It has proved particularly advantageous to provide the sealing element with 4, 5 or 6 waves of equal size distributed uniformly around the circumference, which in use absorb the extension of the material in the circumferential direction. It is true that the same effect could be achieved with a greater number of smaller waves, but these waves would then have to have a proportionally greater curvature which, during manufacture, leads to a greater stretching difference between the top and bottom side of the cut, which causes these smaller waves to have a greater structural inertia and they are less easy to lay smoothly when being fitted. A number of waves less than four leads to an increased stretching of material in the peak area of the waves, whereby the disadvantages associated with the known shaped parts are not satisfactorily eliminated. Preferably the sealing element is formed with five waves. If the structure has a diameter D, the maximum amplitude of the waves is preferably of the order of D/10 and their radius of curvature at the circumference is preferably of the order of D/5.

The amount of excess sectorial surface by which the sealing element is larger than a complete circular surface depends on both the angle between the lateral surfaces forming the corner (the angle $\alpha$ in FIG. 3) and also the inclination of these surfaces relative to the basal surface (the angle $\beta$ in FIG. 3). Generally however the lateral surfaces which form the corner meet together at an angle of 90° so that the part of the sealing element resting on the basal surface covers a circumference of 270°. As a result when the sealing element is being fitted the corner produces a basal surface segment of 90°. As each of the lateral surfaces also forms a quadrant when the lateral surfaces are perpendicular, the excess sectorial surface corresponds to a quadrant in a sealing element of this kind.

BRIEF DESCRIPTION OF THE DRAWINGS

For a better understanding of the present invention, and to show how the same may be carried into effect, reference will now be made, by way of example, to the accompanying drawings, in which.

DETAILED DESCRIPTION OF THE DRAWINGS

Figure 1:
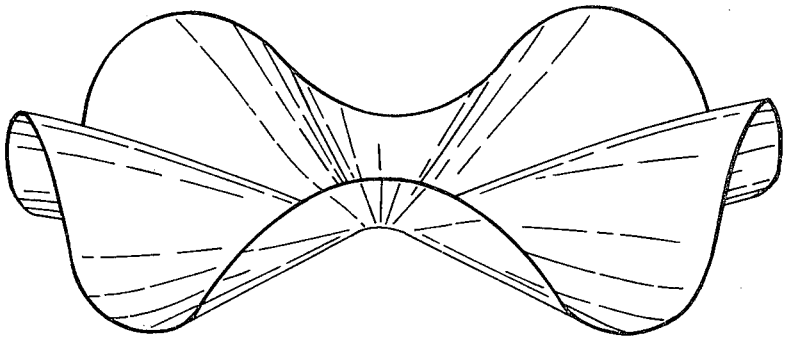
FIG. 1 shows a perspective view of a sealing element of the invention with five waves of equal size distributed uniformly around the circumference.

FIG. 1 shows the sealing element in the non-fitted state as it is obtained immediately after its shaping. The shaped part forming the sealing element consists for example of soft-PVC or polyisobutylene and in a preferred embodiment has a diameter of approximately 210 mm and a thickness of material in the unstretched central area of approximately 1.2 to 1.5 mm.

As shown in FIG. 1 the sealing element has five radial waves to equal size distributed uniformly around the circumference. The structure is such that a surface consisting of a complete circular surface and an additional circular sector surface can be produced from the structure. This surface enlargement, which in order to avoid the disadvantages of the Prior Art described hereinbefore is intentionally not formed in the shape of a single convexity for receiving the corner which is later to be enclosed, is absorbed in this sealing element by the undulatory formation by means of which the surface extension which takes place during the cupping process or pressing process is distributed in an essentially uniform manner over the entire circumference of the shaped part. Therefore, the new sealing elements are preferably manufactured from a plane circular cut in a cupping or pressing mould which already has the shown undulatory formation.

While in known sealing elements formed of a given material and having one single cupped convexity at a pre-determined place a reduction in thickness of more than 50% is observed in the area of the greatest stretching of material, a sealing element in accordance with the invention and made of the same material will have a maximum reduction of thickness on the outer circumference relative to the starting thickness of only approximately 15%. This means that the new elements of the same size can be manufactured from a starting material of lesser thickness, or larger elements can be produced with the same starting material. A substantial enlargement of the known sealing elements was not possible because of the stretching to a great degree in a particular place.

Figure 2:
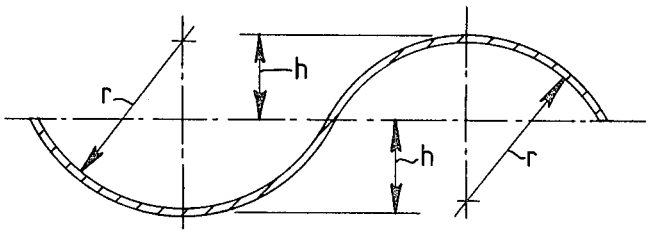
FIG. 2 shows the shape of the circumferential edge of a complete wave in the sealing element of FIG. 1.

In FIG. 2 the shape of the circumferential edge of a complete wave is shown in a sealing element according to FIG. 1. The amplitude $h=21$ mm and the radius $r=43$ mm in the presently preferred embodiment.

Figure 3:
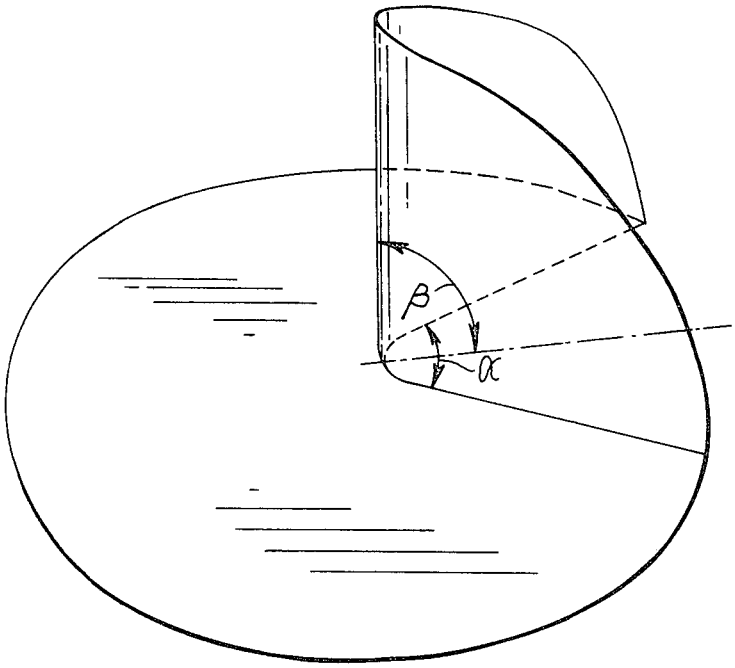
FIG. 3 shows a perspective view of the sealing element of FIG. 1 in the condition it has during its fitting about a corner.

With the dimensions specified above the sealing element shown in FIG. 1 can be shaped in a manner such that, as can be seen from FIG. 3, it lies smoothly on an outer corner, in which case the lateral surfaces forming the corner meet at an angle $\alpha$ of 90° and the outer edge of the corner runs at an angle $\beta$ of 90° to the basal surface. Each of the perpendicular covering surfaces of the sealing element then forms a quadrant, whereby a surface equivalent to a semi-circle results. In this conformation, then, the structure comprises a flat base in the form of a reflex sector of a circle of angle $360°-\alpha$, together with the upstanding portions bounding the "missing sector" of angle $\alpha$, each of these upstanding portions being in the form of a quadrant. Hence the structure can be considered to have an "excess sectorial surface" by virtue of the fact that the structure encloses a total angle of $(360-\alpha)°+180°$ as measured about the mid-point of the structure. The excess sectorial surface can thus be given an angular qualification which equals $(180-\alpha)°$.

If the inclination of the lateral surfaces forming the outer edge of the corner differs from the perpendicular position (which frequently occurs, as is for example the case in tubing rings for light cupolas), sealing elements can also be used in which the basal surface consists of a circular base covering $(360-\alpha)$ degrees with an angle $\beta$ at the centre of less than 90°.

Thus with a sealing element of this invention it is possible to provide a sealing surface covering more than 360° without straining any region of the element.

What is claimed is:

1. A sealing element made of a water-resistant elastomer or plastomer for outer corners on flat roofs and similar engineering constructions, which comprises a lamelliform structure of substantially circular shape having inclusively from four to six waves distributed radially throughout the structure and around the entire circumference of the structure, the amplitudes of which waves increase regularly from the centre of the structure towards the circumference.

2. A sealing element as claimed in claim 1, wherein there are five waves of equal size distributed uniformly around the circumference of the structure.

3. A sealing element as claimed in claim 1, wherein the waves are such that the sealing element can be stretched to form a flat base in the form of a reflex sector of a circle from which there extends, out of the plane of the circle, a portion of the sealing element in the form of two adjoining quadrants.

4. A sealing element as claimed in claim 1, which is manufactured from soft PVC or a polyisobutylene.

5. A sealing element as claimed in any preceding claim, wherein the sealing element has a diameter of 150 to 300 mm.

6. A sealing element as claimed in claim 1, wherein the amplitude of the waves, at the circumference of the structure, is about D/10, and their radius of curvature, at the circumference of the structure, is about D/5, where D=the diameter of the sealing element.

7. A sealing element as claimed in claim 6, which has a diameter of about 210 mm and in which there are five waves which, at the circumference of the structure, have an amplitude of about 21 mm and a radius of curvature of about 43 mm.

8. A sealing element for corners on flat roofs and similar engineering constructions, which is made of water-resistant soft PVC or a polyisobutylene, and which comprises a lamelliform structure of substantially circular shape having inclusively from four to six waves distributed radially throughout the structure which waves extend around the entire circumference to the structure, the amplitude of the waves increasing linearly from the centre of the structure towards the circumference.

9. A sealing element as claimed in claim 8, wherein the amplitude of the waves, at the circumference of the structure, is about D/10, and their radius of curvature, at the circumference of the structure, is about D/5, where D=the diameter of the sealing element.

* * * * *